US008539728B2

(12) United States Patent
Simonson et al.

(10) Patent No.: US 8,539,728 B2
(45) Date of Patent: Sep. 24, 2013

(54) FLOORING APPARATUS AND SYSTEMS FOR IMPROVED REDUCTION OF IMPACT FORCES DURING A FALL

(75) Inventors: Samuel J. Simonson, Fort Wayne, IN (US); Robert J. Michael, Erie, PA (US)

(73) Assignee: Sorbashock LLC, Fort Wayne, IN (US)

( * ) Notice: Subject to any disclaimer, the term of this patent is extended or adjusted under 35 U.S.C. 154(b) by 0 days.

(21) Appl. No.: 12/890,654

(22) Filed: Sep. 25, 2010

(65) Prior Publication Data

US 2011/0072748 A1 Mar. 31, 2011

Related U.S. Application Data

(60) Provisional application No. 61/246,094, filed on Sep. 26, 2009.

(51) Int. Cl.
*E04F 15/22* (2006.01)

(52) U.S. Cl.
USPC ..... 52/403.1; 52/1; 52/263; 52/177; 52/181

(58) Field of Classification Search
USPC ..... 52/403.1, 1, 263, 177, 181
See application file for complete search history.

(56) References Cited

U.S. PATENT DOCUMENTS

| | | | | |
|---|---|---|---|---|
| 3,636,575 | A | 1/1972 | Smith | |
| 4,557,475 | A | 12/1985 | Donovan | |
| 4,727,697 | A | 3/1988 | Vaux | |
| 4,846,457 | A | 7/1989 | Vaux | |
| 4,948,116 | A | 8/1990 | Vaux | |
| 4,991,834 | A | 2/1991 | Vaux | |
| 4,998,717 | A | 3/1991 | Vaux | |
| 5,542,221 | A * | 8/1996 | Streit et al. | 52/403.1 |
| 8,109,050 | B2 | 2/2012 | Ovaert | |
| 2003/0175497 | A1* | 9/2003 | Kobe et al. | 428/317.9 |
| 2006/0236487 | A1* | 10/2006 | Dean | 15/215 |
| 2007/0092694 | A1 | 4/2007 | Scott et al. | |
| 2007/0204545 | A1 | 9/2007 | Ovaert | |

FOREIGN PATENT DOCUMENTS

| | | | |
|---|---|---|---|
| EP | 1138845 | A1 | 10/2001 |
| WO | 9530811 | A1 | 11/1995 |

OTHER PUBLICATIONS

International Preliminary Report on Patentability, PCT/US2010/050319, issued Mar. 27, 2012 by KIPO (ISA/KR).

Laing and Robinovitch, "Low stiffness floors can attenuate fall-related femoral impact forces by up to 50% without substantially impairing balance in older women," Accident Analysis and Prevention 41 (2009) 642-650.

* cited by examiner

*Primary Examiner* — Mark Wendell
(74) *Attorney, Agent, or Firm* — O'Connor & Company; Ryan P. O'Connor

(57) ABSTRACT

This invention provides a flooring apparatus comprising: (a) a flooring plate; (b) a plurality of columns extending from an underside of the flooring plate, wherein at least some of the columns deform when the flooring plate is subjected to a pressure equal to or greater than a critical buckling pressure; and (c) a matrix material in at least partial contact with the columns. The present disclosure includes many variations of such apparatus, such as various column designs, material selection criteria, and end-use considerations. This invention also provides a flooring system for mitigating injuries associated with falls, the system comprising a plurality of flooring apparatus each provided in accordance the present disclosure. The flooring system can include one or more types of modular tiles, or any other configuration (such as mats).

22 Claims, 14 Drawing Sheets

FLOORING APPARATUS AND SYSTEMS FOR IMPROVED REDUCTION OF IMPACT FORCES DURING A FALL

PRIORITY DATA

This patent application claims priority under 35 U.S.C. §120 from U.S. Provisional Patent Application No. 61/246,094 for "FLOORING APPARATUS AND SYSTEMS FOR IMPROVED REDUCTION OF IMPACT FORCES DURING A FALL," filed Sep. 25, 2009, the disclosure of which is hereby entirely incorporated by reference herein for all purposes.

FIELD OF THE INVENTION

The present invention relates to apparatus, such as flooring apparatus, for reducing impact energy and forces during a fall.

BACKGROUND OF THE INVENTION

It is known that falls represent a leading cause of non-fatal injuries in the United States. A number of epidemiological studies have reported a drastic increase of fall incidence rate in the population over the age of 65, suggesting a direct relationship between aging and the frequency of fall events. It has been estimated that approximately 30% of all individuals over the age of 65 have at least one fall per year. When the dramatic growth in the number of people over 65 and their proportion in the population is considered, this situation represents a significant health problem.

Typically, current approaches to solving the problem of injury from falls include devices which use composite matting to absorb energy resulting from patient/floor impact during falls. For example, U.S. Pat. Nos. 3,636,577, 4,557,475, 4,727,697, 4,846,457, 4,948,116, 4,991,834 and 4,998,717 each describe impact-absorbing coverings which utilize air-filled cells or compressible materials to absorb the energy of a fall. Because each of these systems is always compliant (i.e., always deformable under compressive pressures), shoes, feet, and/or other contacts with the flooring surface result in relatively large mat deflections. This property has the potential to increase the likelihood of falls due to toe/mat interference during foot swing, and/or presents a problem when an individual attempts to move an object over the floor (e.g., a wheelchair). These factors can be of even greater concern in a health care setting, where many residents may have an unsteady gait and/or utilize wheelchairs.

Recently, Laing and Robinovitch, "Low stiffness floors can attenuate fall-related femoral impact forces by up to 50% without substantially impairing balance in older women," *Accident Analysis and Prevention* 41 (2009) 642-650, describe the important tradeoffs and shortcomings associated with several flooring systems known in the art.

In view of the known limitations, it would be desirable to provide improved flooring apparatus and systems that are dual-stiffness—that is, exhibit good stiffness under normal conditions but are compliant and shock-absorbing when a fall occurs. Specifically, what is needed is a flooring apparatus that retains a solid feel and remains stable during normal activities; whereas when a fall occurs, the flooring apparatus cushions the body at acute points and absorbs a significant amount of the impact, including an amount that is improved over the prior art. Commercially practical systems and methods to implement the flooring apparatus are also needed.

Additionally, improvements to the prior art are needed to better address commercial needs. The prior art includes U.S. Patent App. Pub. No. 2007/0204545A1, entitled "FLOORING APPARATUS FOR REDUCING IMPACT ENERGY DURING A FALL" which publication is hereby incorporated by reference herein, in its entirety.

SUMMARY OF THE INVENTION

The present invention addresses the aforementioned commercial needs.

In some variations, this invention provides a shock-absorbing apparatus comprising:

(a) an outer plate for receiving a force associated with an impact of a human;

(b) a plurality of columns extending from an inner surface disposed on the opposite side of the outer plate, wherein at least some of the columns buckle when the outer plate is subjected to a dynamic pressure equal to or greater than a critical dynamic buckling pressure; and (c) a matrix material in at least partial contact with the columns, wherein the apparatus provides a G-force attenuation of at least 50%, preferably at least 75%, and more preferably at least 90%, compared to the apparatus without the columns or the matrix material.

In some embodiments, the critical dynamic buckling pressure is from about 18 psi to about 45 psi. In some embodiments, the columns do not buckle when the outer plate is subjected to a static pressure up to a critical static buckling pressure from about 60 psi to about 300 psi.

The matrix material may have a density selected from about 1 $lb/ft^3$ to about 12 $lb/ft^3$. The density of the matrix material is optionally selected to optimize the stiffness of the columns. In some embodiments, the matrix material increases the stiffness of the columns by at least 50%, such as at least 75%, compared to the column stiffness in the absence of the matrix material.

In some embodiments, the matrix material includes both a structural material with a first stiffness and a viscoelastic material with a second stiffness that is lower than the first stiffness. In certain embodiments, the matrix material is configured with cell structures that are not isotropic.

In some embodiments, the outer plate has a flexural modulus selected from about 5,000 psi to about 25,000 psi. The flexural modulus of the matrix material, in certain embodiments, is about the same as the flexural modulus of the outer plate.

The apparatus may be a flooring apparatus with the outer plate including, or consisting of, a flooring plate. The invention is not, however, limited to flooring apparatus or systems.

The invention, in some variations, relates to a flooring apparatus comprising:

(a) a flooring plate for receiving a force associated with an impact of a human;

(b) a plurality of columns extending from an inner surface disposed on the opposite side of the flooring plate, wherein at least some of the columns buckle when the outer plate is subjected to a dynamic pressure equal to or greater than a critical dynamic buckling pressure; and (c) one or more flame retardants contained within or on a surface of the flooring plate.

The flame retardant may be selected from the group consisting of alkyl phosphates, amino phosphates, phosphazenes, phosphorous, and halogenated derivatives of any of the foregoing.

In certain embodiments, the apparatus is fabricated from one or more thermoplastic polyurethanes. In some embodiments, one or more anti-microbial materials are included within or on a surface of the flooring plate.

The flooring apparatus may include a matrix material in at least partial contact with the columns. One or more flame retardants may be included within the matrix material. Additionally, or more flame retardants may be included in or on the flooring plate.

In some embodiments of the flooring apparatus, the critical dynamic buckling pressure is from about 18 psi to about 45 psi. The columns preferably do not buckle when the outer plate is subjected to a static pressure up to a critical static buckling pressure, such as from about 60 psi to about 300 psi.

These or other variations provide a flooring apparatus comprising a flooring plate and a plurality of columns extending from an inner surface disposed on the opposite side of the flooring plate, wherein the columns are capable of buckling under a sufficient G-force;

wherein the columns, when buckled, store potential energy received from the G-force in the form of strain energy to enhance resilience of the flooring apparatus; and wherein the apparatus provides a G-force attenuation of at least 50% compared to the apparatus without the columns.

In some embodiments, at least a portion of the columns are configured for buckling about any axis. In some embodiments, at least a portion of the columns are substantially round in cross section.

Certain embodiments of the invention include a two-stage buckling configuration, wherein a first column type is designed to buckle under a first critical buckling pressure, and wherein a second column type is designed to buckle under a second critical buckling pressure that is higher than the first critical buckling pressure.

DETAILED DESCRIPTION OF EMBODIMENTS OF THE INVENTION

Figure 1A:
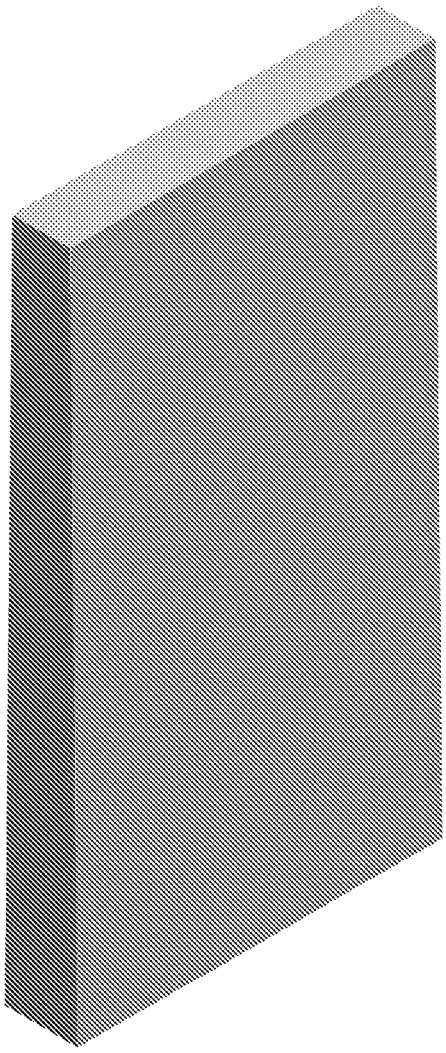
FIG. 1A shows one exemplary column design that can be employed in certain embodiments of the invention.

The apparatus, systems, and methods of the present invention will now be described in detail by reference to various non-limiting embodiments of the invention.

Unless otherwise indicated, all numbers used in the specification and claims are to be understood as being modified in all instances by the term "about." Without limiting the application of the doctrine of equivalents to the scope of the claims, each numerical parameter should at least be construed in light of the number of significant digits and by applying ordinary rounding techniques.

As used in this specification and the appended claims, the singular forms "a," "an," and "the" include plural referents unless the context clearly indicates otherwise.

All patents, patent applications, and publications recited in this patent application are hereby incorporated by reference herein in their entireties.

Some variations of the invention relate to certain registered or unregistered trademarks commonly owned by the assignee of this patent application. Such trademarks include, but are not limited to, SorbaShock™, Dual-Stiffness™, and graphical forms (e.g., logos), similarities, or equivalents thereof.

Some variations of the present invention are premised, at least in part, on modifications and improvements to the impact-absorbing flooring systems described in U.S. Patent App. Pub. No. 2007/0204545A1. Such modifications and improvements include both physical and chemical considerations, and relate to apparatus, systems, methods of making the flooring apparatus, and methods of using the flooring apparatus.

Certain preferred embodiments of the present invention will be described in more detail, including reference to the accompanying figures. The figures are understood to provide representative illustration of the invention and are not limiting in their content or scale. It will be understood by one of ordinary skill in the art that the scope of the invention extends beyond the specific embodiments depicted.

Preferred flooring apparatus and systems include a plurality of columns extending from an underside of a top surface or plate. The columns can buckle under certain pressures associated with a fall of a person (or object), but the columns remain substantially rigid during normal conditions. By "buckle" it is meant that one or more columns deform or deflect forces in a manner that reduces the force returning back to the person who fell, thereby reducing or preventing injury.

In some variations, the flooring apparatus comprises a matrix material in at least partial contact with the columns, wherein the matrix material may enhance the stiffness of the columns. The matrix material does not necessarily occupy all of the space around the columns under the top surface. The matrix material may include a solid, liquid, or vapor material, or mixtures of any of these. In some embodiments, the matrix material includes a compressed gas, such as air, nitrogen, or carbon dioxide. In some embodiments, the matrix material includes a viscous liquid or gel. In some embodiments, the matrix material includes a natural or synthetic solid material, such as a viscoelastic polymer foam.

In some variations of this invention, the flooring apparatus does not include a matrix material in contact with the columns. In these variations, the columns are designed (geometrically and chemically) to provide acceptable stiffness and resilience for the intended application. Generally, material selection for the flooring plate and columns should follow what is taught herein, including preferred mechanical properties. Low-density polyethylene is an exemplary material for the flooring plate and columns without a matrix material present.

Column stiffness and column resilience are important considerations for the design of the flooring apparatus, as will be recognized by a person of ordinary skill in this art. Stiffness is the resistance of an elastic body to deformation by an applied force. The stiffness of a column is a measure of the resistance offered by the column to deformation (bending, stretching, or compression). It is an extensive material property, unlike elastic modulus which is a property of the constituent material. The column stiffness is dependent on the specific column material as well as the shape and boundary conditions, including the presence (and properties) of a matrix material.

Resilience is the property of a material to absorb energy when it is deformed elastically and then, upon unloading, to have this energy recovered. Resilience is the maximum energy per unit volume that can be elastically stored. The column resilience will be a function of the specific column material selected but not on any surrounding foam or other material, if present.

In certain embodiments of the invention, a matrix material is selected and suitably introduced (e.g., by injection molding) so that the column stiffness is increased by at least about 25%, preferably at least about 50%, and more preferably at least about 75%, compared to the stiffness of the columns without the matrix material. Criteria for selection of the matrix material are described below.

Another important parameter of the flooring apparatus is the flexural modulus associated with the flooring plate. The flooring plate is typically the top layer of the apparatus, situated above the columns and suitable for physical contact with a user. Reference herein to "plate" includes a top layer or plurality of layers that may or may not be integrally formed with the columns. The flexural modulus is the ratio of stress to strain in flexural deformation, or the tendency for a material to bend. It is an intensive property, and so only depends on the material selected for the flooring plate.

This flexural modulus is regarded as important because if it is too low, the flooring apparatus will tend to have a soft feel and can actually promote falls. If the flexural modulus is too high, there can be insufficient transfer of forces through the flooring plate to the columns, thereby reducing the effectiveness of the overall system.

In some embodiments, the flexural modulus of the flooring plate is selected from about 5,000 psi to about 25,000 psi, such as from about 10,000 psi to about 20,000 psi. Various embodiments of the invention employ a flooring plate with a flexural modulus of about 10,000, 11,000, 12,000, 13,000, 14,000, 15,000, 16,000, 17,000, 18,000, 19,000, or 20,000 psi.

In certain embodiments, the flooring apparatus includes (i) a flooring plate fabricated from a material of selected flexural modulus, (ii) a plurality of columns, and (iii) a matrix material in contact with the columns, wherein the matrix material has a similar flexural modulus as the selected flexural modulus for the material employed in the flooring plate.

In some embodiments, a low (e.g., less than 10,000 psi) flexural modulus is selected, in conjunction with the presence of a matrix material capable of increasing the column stiffness so that the overall apparatus maintains a reasonable feel to a user.

As will be appreciated, a wide variety of materials can be independently selected for each of the components of the flooring apparatus. It should also be noted that the flooring plate can be fabricated from the same material as that used for the columns, but this is by no means necessary.

The matrix material is typically different than the material used for the columns and/or flooring plate, but in principle the matrix material could be the same or a similar chemical composition but with different physical properties. For example, the columns could be produced from a selected polymer while the matrix material could be produced from the same polymer prepared by injecting $CO_2$ or another gas, to reduce the density of the polymer before or during injection of the matrix material.

The matrix material may have a density of about 1 $lb/ft^3$ to about 12 $lb/ft^3$, for example. In some embodiments, the matrix material has a density of less than about 5 $lb/ft^3$, or less than about 3 $lb/ft^3$. The density of the matrix material may be selected to optimize the stiffness of the columns.

In certain variations, the columns, matrix material (if present), and flooring plate are produced from thermoplastics or thermoset materials, which materials may include plastics, elastomers, and composites. Thermoplastics may include polyether or polyester materials, for example. One or more elastomeric gels or viscoelastic thermoset materials may be employed. In some embodiments, one or more composites materials are employed, such as extruded metal oxides. Polyurethanes are preferred in some embodiments. In some embodiments, a thermoset polyurethane is employed for the flooring plate, columns, and/or matrix material.

Thermoplastic or thermoset polyurethanes include urethane linkages produced by reacting an isocyanate group, —N═C═O with a hydroxyl group, —OH. Polyurethanes are produced by the polyaddition reaction of a polyisocyanate with a polyalcohol (polyol) in the presence of a catalyst and other possibly additives, such as surfactants. Isocyanates can be classed as aromatic, such as diphenylmethane diisocyanate or toluene diisocyanate; or aliphatic, such as hexamethylene diisocyanate or isophorone diisocyanate.

Polyurethanes are typically produced with one or more chain extenders or cross-linking agents, which are generally low-molecular-weight hydroxyl- and amine-terminated compounds. Exemplary chain extenders include ethylene glycol, 1,4-butanediol, 1,6-hexanediol, cyclohexane dimethanol, hydroquinone bis(2-hydroxyethyl)ether, diethylene glycol, glycerine, and trimethylolpropane.

Polyurethanes have the ability to be turned into a foam. In some embodiments, blowing agents such as water, certain halocarbons (such as 1,1,1,3,3-pentafluoropropane), and hydrocarbons such as n-pentane, may be incorporated.

Certain embodiments utilize Texin® polyurethanes (Bayer, Pittsburgh, Pa., US) for the flooring plate and/or columns. Texin is generally an aromatic polyester-based thermoplastic polyurethane; there are several grades currently available. For example, blends of Texin 255 and Texin DP7 can be employed, in some embodiments. In other embodiments, Texin 260 and Texin DP7 can be employed.

In some embodiments, BASF polyurethanes are employed for the flooring plate and/or columns. Certain embodiments employ Elastollan® thermoplastic polyurethane elastomers, such as grades S 60 A, S 70 A, S 80 A, S 85 A, S 90 A, S 95 A, S 98 A, S 60 D, S 64 D, or S 74D. These thermoplastic polyurethane elastomers offer good mechanical properties and wear resistance, good damping characteristics, and a high resilience performance. Also, these elastomers are processable by injection molding.

In some embodiments, the matrix material is a high-resilience polyurethane foam or a viscoelastic memory polyurethane foam such as Bayfit®. Other embodiments utilize Sorbothane® (Sorbothane, Inc., Kent, Ohio, US) as the matrix material. Sorbothane is a viscoelastic polymer that combines shock absorption, good memory, vibration isolation, and vibration damping characteristics. Sorbothane also has a low creep rate compared to other polymers. Introduction of the foam can be achieved by injection molding, which is well-known.

Certain embodiments employ mechanically engineered foams, i.e. foams whose cell structures are not isotropic. Cell structures can be engineered so that they deflect only under sufficiently high loading. For example, Carpenter Co. (Indiana, US) manufactures Omalon® elliptical cells that collapse in horizontal layers under increased loading. Mechanically engineered foams may reduce the column height and therefore thickness of the flooring apparatus.

In some embodiments, a dual-stiffness matrix material is employed. For example, in some embodiments, the matrix material includes a rigid, structural material and a flexible, viscoelastic material, each having a different stiffness. Co-injection molding may be utilized in the process of forming the matrix material disposed adjacent to the columns.

In some embodiments, a matrix material includes one or more surfaces or regions that vary in properties from the bulk of the matrix material. For example, the matrix material may include a bulk foam material and an integral-skin foam that is formed or present substantially as closed cells. The integral skin may have different properties from the bulk material, such as a higher density or better resistance to moisture, for instance.

In some embodiments, the matrix material is primarily based on petroleum feedstocks. While soybean oil derivative polyols are entering the market, formulations often require a large percentage of petroleum-based polyol to obtain desirable properties. Some embodiments use polyols at varying hydroxyl values tailored for the flooring application (e.g., Battelle, Columbus, Ohio). Bio-based and organic product syntheses are preferred as renewable resources, adding significant benefit to the matrix material.

In some variations, an ozonolysis process is employed to produce soybean oil derivatives from polyols, at about 10-50 wt % (for example) in the matrix material. In another variation, crude glycerin is used to produce derivatives from polyols for introduction into the matrix material.

In some embodiments, smart polymers are useful in the flooring apparatus as a matrix material. Exemplary smart polymers include those developed by the Cornerstone Research Group, Inc. (Dayton, Ohio), designed to change physical properties in response to a variety of stimuli such as, but not limited to, force, vapor pressure, heat, water, and current. In other variations, shape-memory products with microspheres are used in the matrix material. In another embodiment, syntactic foams can provide commodity cost benefits as a preferred matrix material.

In some variations, the matrix material is a polymeric foam comprised of nanoparticles and polymer blends that allow good control of cell morphology and foam density in the manufacturing process, reducing the cost and weight for a given polymeric foam volume by 20%, 50%, or more. In some embodiments, the matrix material is a polymer foam with nitrogen-containing lightweight nanofibers using different combinations of supports (MgO and $SiO_2$) and metals (Co, Fe, and/or Ni) for mechanical reinforcement.

The weight of the flooring apparatus may be reduced by introduction of nitrogen-containing nanotubes, carbon nanofibers, or other nanotubes, nanofibers, or nanoparticles. In some embodiments, a thermoplastic material of the flooring plate is compounded with nitrogen-containing nanofibers. In other embodiments, nitrogen-containing nanotubes are blended into a thermoplastic material during manufacturing of the flooring plate.

Nitrogen-containing nanofibers, carbon nanotubes, or nanofibers may be introduced, for example, during production of the flooring plate. In other embodiments, the nitrogen-containing nanofibers may be compounded into a thermoplastic or viscoelastic polymer.

In some embodiments, the matrix material is fabricated with one or more fire retardants. For example, the matrix material may include a polymer foam with nitrogen-containing carbon nanofibers containing Co-based catalysts for fire-retardant properties.

In some embodiments, a reinforcing matrix material made of cork and rubber calendared sheet (Beacon Rubber & Gasket, Lakewood, Ohio) is added to a flooring apparatus in thicknesses of ⅛", 1/16", ⅜", or ½" after it is fabricated, or even before it is installed at its point of use to improve force attenuation by 5-35%, or more. In some embodiments, a reinforcing matrix material made of cork, rubber, and preferably a viscoelastic polymer with urethane binder is added to the flooring apparatus.

In combination with a flooring apparatus, a reinforced matrix material may be attached to the commercial flooring material as a backing or underlayment to further improve force attenuation. In some embodiments, the reinforcing matrix of cork and rubber calendared sheet acts as a moisture barrier on concrete slab prior to installing a flooring apparatus.

In various embodiments, the flooring plate is produced in an extrusion, co-extrusion, or pultrusion process. In certain embodiments, the flooring plate may be produced using Tycor® processing technology (Webcore Technologies, LLC, Miamisburg, Ohio, US).

In some embodiments, the flooring apparatus is characterized by a critical buckling pressure. When the flooring apparatus is subjected to a compressive pressure less than a critical buckling pressure, the columns remain substantially rigid to prevent deflection of the floor. When the flooring apparatus is subjected to a compressive pressure greater than the critical buckling pressure, the columns are expected to buckle.

A skilled artisan, in view of the present disclosure, will realize that the critical buckling pressure should be within a certain range for the flooring apparatus to be effective. If the critical buckling pressure is too high, the columns will not deform when a person having a typical weight falls, and the force will not be effectively attenuated. If the critical buckling pressure is too low, the columns may deform under ordinary conditions not associated with a fall.

It has been found, experimentally, that critical buckling pressures in the range of about 10 psi to about 80 psi are desired. In certain embodiments, the critical buckling pressure is designed to be from about 18 psi to about 45 psi, such as about 20, 25, 30, 35, or 40 psi.

In preferred embodiments, the flooring apparatus may be characterized by two critical buckling pressures: a critical static buckling pressure and a critical dynamic buckling pressure. The reason for two critical buckling pressures is that it has been discovered that, in preferred apparatus, the static load-carrying capability is higher than the dynamic force that causes buckling. The result is that columns do not buckle when the outer plate is subjected to a static pressure up to a critical static buckling pressure, even if the static pressure is significantly higher than the critical dynamic buckling pressure.

This feature is beneficial for practical reasons, because it allows for the continual presence of beds, furniture, wheelchairs, equipment, testing stations, carts, heavy fire extinguishers, security boxes, and so on, without causing column buckling. An important example is that a rolling wheelchair, occupied by a person of 150-250 lb, caused no load deflection to the flooring apparatus of the invention.

The critical static buckling pressure is higher than the critical dynamic buckling pressure. Without being limited by any particular theory, it is believed that in a static, steady-state situation, forces are able to distribute more efficiently throughout the flooring plate, matrix material (if present), columns, and the bottom surface (e.g., concrete floor). In contrast, a dynamic force caused by a sudden impact, such as associated with a fall of a person, cannot be distributed as efficiently in space and time.

The system complexity is such that computational modeling cannot perfectly predict these buckling pressures as a function of materials and mechanical properties. Particularly, current models cannot accurately predict both the critical dynamic buckling pressure and critical static buckling pressure, or the differential between the two parameters.

The preferred ranges for these critical buckling pressures have been found through experimentation and will change with the apparatus materials selected. Critical dynamic buckling pressures in the range of about 10 psi to about 80 psi are desired. In certain embodiments, the critical dynamic buckling pressure is designed to be from about 18 psi to about 45 psi, such as about 20, 25, 30, 35, 40, or 45 psi. Critical static buckling pressures may be in the range of about 60 psi to about 300 psi, such as about 75, 90, 105, 120, 135, 150, 165, or 180 psi.

In one exemplary embodiment, the critical static buckling pressure is about 85 psi and the critical dynamic buckling pressure is about 25 psi. In another exemplary embodiment, the critical static buckling pressure is about 100 psi and the critical dynamic buckling pressure is about 30 psi. In various embodiments, the critical static buckling pressure is about 10, 20, 30, 40, 50, 60, 70, 80, 90 psi or more higher than the critical dynamic buckling pressure.

Preferred embodiments of the flooring apparatus are capable of significantly attenuating the force caused by impact during a fall. As used herein, "force" includes both absolute force as well as force per unit area, i.e. pressure. Also, during a fall, there is a distribution of force as a function of both space and time. The peak of this distribution ("peak force") can be an important factor with respect to injuries. Therefore, preferred embodiments significantly reduce the peak force.

Forces can be measured in several ways. In one test, a flooring apparatus is subjected to a "G-force test" wherein a 20-kg mass is dropped from a 0.35-meter height; the acceleration is measured (in $m/s^2$ or g's) and can be compared to the acceleration measured on a hard surface, e.g. a concrete floor with a wood surface.

Measured according to a G-force test or another suitable measurement, various embodiments of the invention provide for a G-force attenuation of at least 50%, and preferably at least 75%, such as about 80%, 85%, 90%, 91%, 92%, 93%, 94%, 95% or more, relative to a standard floor or to a flooring plate only. Preferred embodiments provide a force attenuation of greater than 90%.

Force attenuation is adjustable in accordance with the present invention. For example, adjusting one or more of the flexural modulus of the flooring plate, the flexural modulus of the matrix material, the density of the matrix material, or the stiffness of the columns, will alter the force attenuation that may be achieved. Additionally, physical design parameters associated with the columns will change the force attenuation capabilities of the apparatus.

Figure 1B:
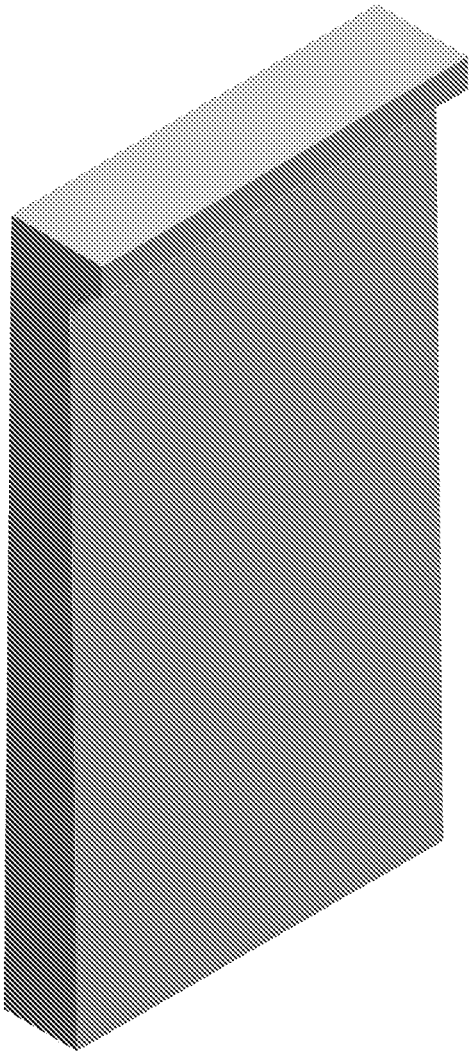
FIG. 1B shows an alternative column design that can be employed in some embodiments of the invention.

FIGS. 1A-1J depict various column designs that may be employed in this invention. These column designs are not intended to limit the scope of the invention. The rectangular column shown in FIG. 1A is capable of buckling in two directions. The column shown in FIG. 1B is a modification to the column in FIG. 1A. Namely, the FIG. 1B column is designed to buckle to one side (uni-directional buckling). The intended behavior is similar to an eccentrically loaded column, with potentially more-predictable column buckling.

Figure 1C:
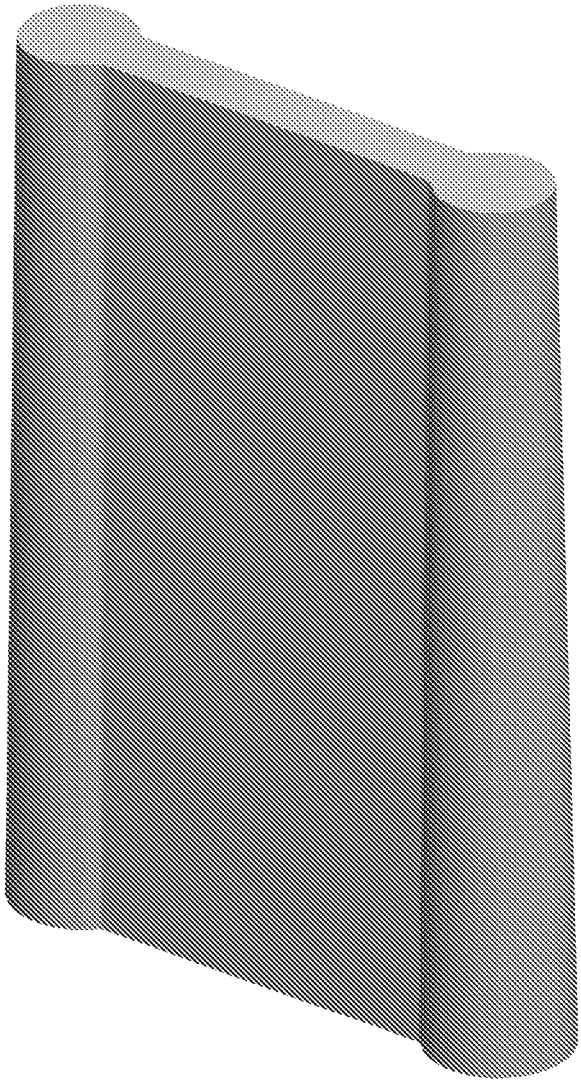
FIG. 1C shows an alternative column design that can be employed in some embodiments of the invention.

Another modification is the embodiment shown in FIG. 1C, which shows a column having a rectangular portion and two substantially cylindrical portions integrally disposed therein. An increase in section modulus is expected to confer stiffer buckling.

Figure 1D:
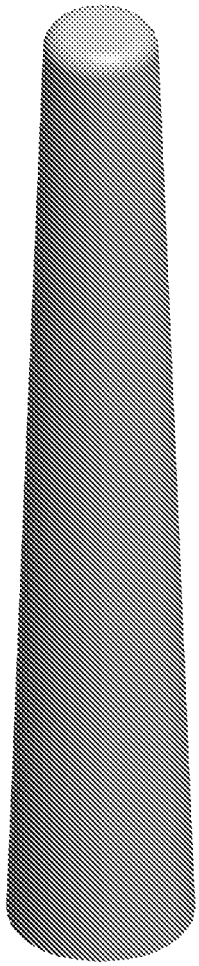
FIG. 1D shows an alternative column design that can be employed in some embodiments of the invention.
Figure 1E:
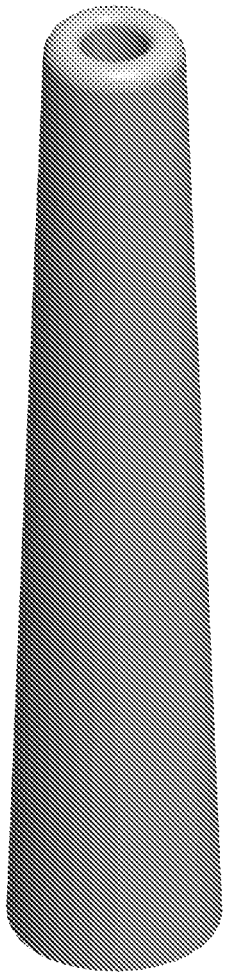
FIG. 1E shows an alternative column design that can be employed in some embodiments of the invention.
Figure 1F:
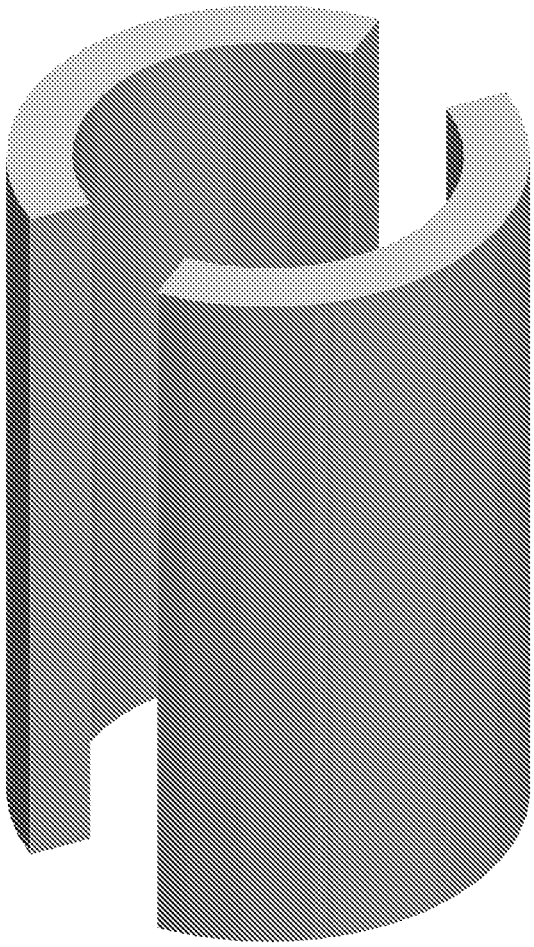
FIG. 1F shows an alternative column design that can be employed in some embodiments of the invention.
Figure 1G:
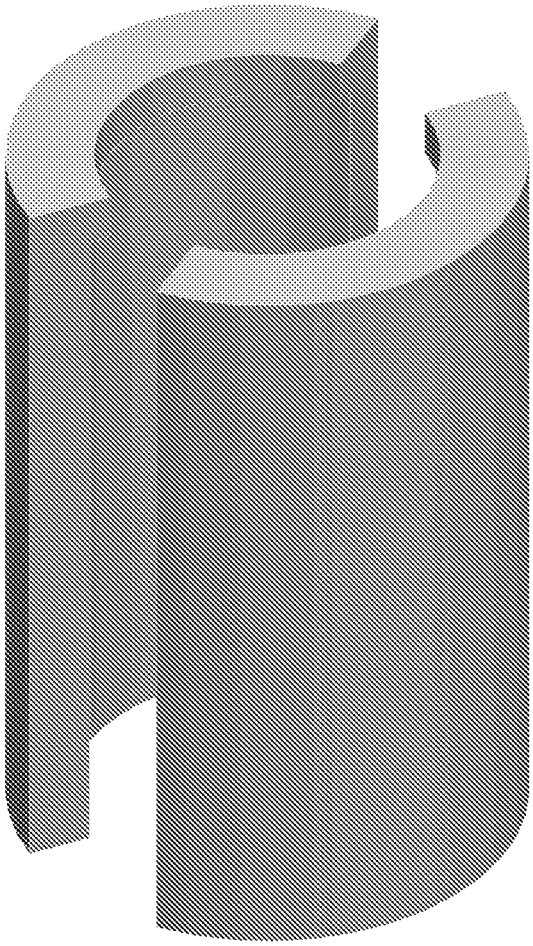
FIG. 1G shows an alternative column design that can be employed in some embodiments of the invention.
Figure 1H:
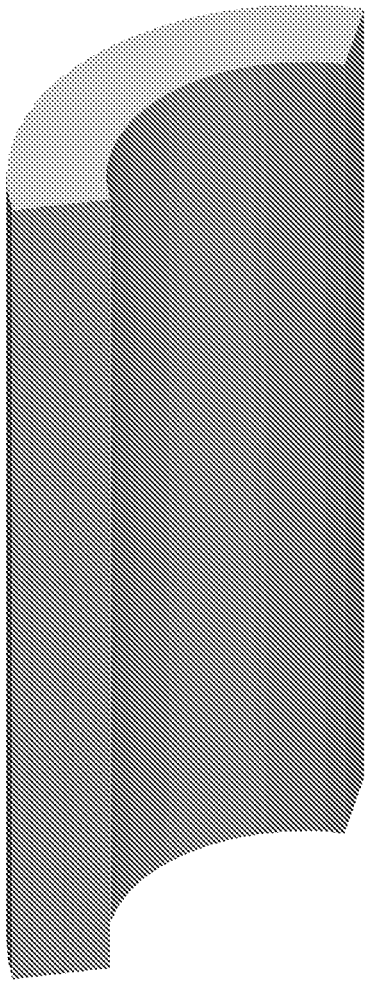
FIG. 1H shows an alternative column design that can be employed in some embodiments of the invention.
Figure 1I:
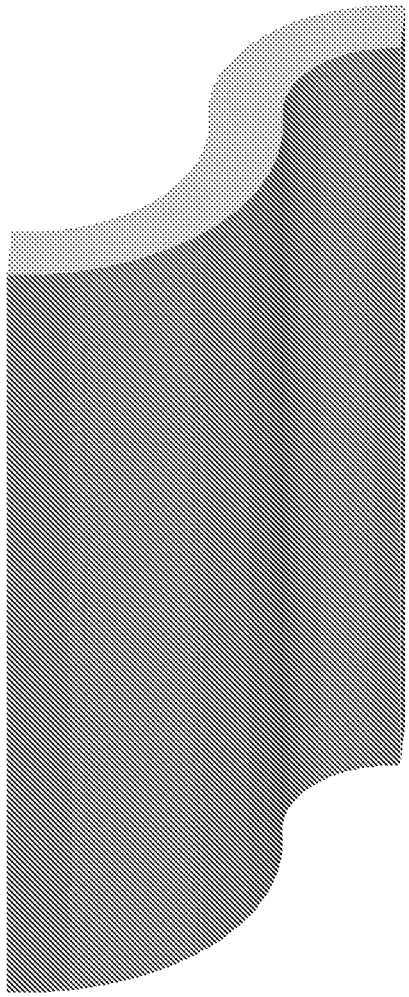
FIG. 1I shows an alternative column design that can be employed in some embodiments of the invention.
Figure 1J:
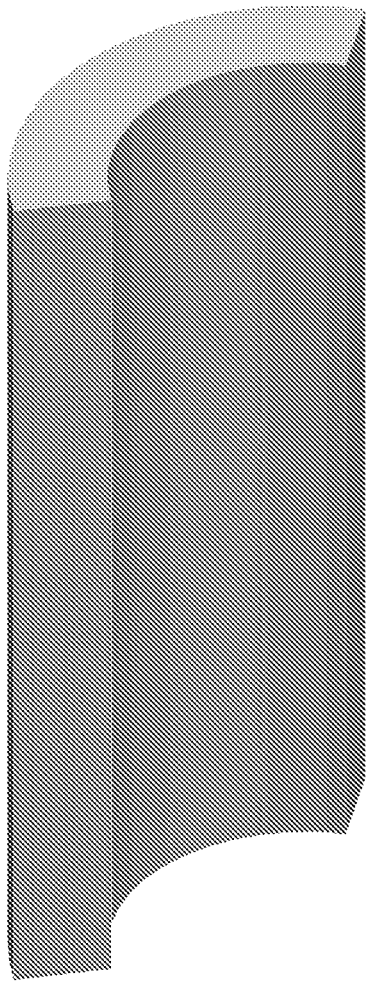
FIG. 1J shows an alternative column design that can be employed in some embodiments of the invention.

In some variations, such as those shown in FIGS. 1D and 1E, stiffening columns are substantially round (in the width dimension), rather than rectangular. Round columns do not have a weak and strong axis, so these columns are capable of buckling about any axis. The length and diameter of round columns can vary, depending on the overall properties desired and the specific materials selected.

Other variations for column design are shown in FIGS. 1F to 1J. These variations utilize the cross-sectional geometry of the column itself to store potential energy in the form of strain energy after the buckle. This strain energy is expected to help the column spring back to its initial height after the load is removed, thereby enhancing the resilience of the flooring apparatus. This effect can be enhanced, in some embodiments, by stiffening or constraining the free end of a column.

The column height can be represented by the parameter H. It is recognized that, for commercial reasons, H is preferably minimized within constraints of material properties and system performance. In some variations, H is less than about 1 inch, such as about 15/16", 7/8", 13/16", 3/4", 11/16", 5/8", 9/16", 1/2" or even less. The invention is by no means limited to any particular value for H.

The column widths (in the case of rectangular column geometries), diameter (in the case of circular column geometries), and other dimensions (in the case of irregular, hybrid, or complex column geometries) may vary. Provided reasonable properties and functionality (e.g., force attenuation) are realized, these design parameters will typically be dictated by manufacturing cost and convenience. Also, columns may contain tapers (draft angles) to facilitate release from a mold during fabrication. Such tapering is well-known to a skilled artisan.

Some embodiments of the invention employ deflection stops adjacent to, or near, each of the columns to avoid over-buckling the columns and placing too much stress on the material of the columns. In some embodiments, some or all of the columns, and/or some portion of the matrix material, are attached to a bottom surface, such as a concrete subfloor. The attachment may be accomplished by a glue or adhesive, for example, applied to one or more of the bottom of the columns, bottom surface of the matrix material, and/or top surface of the subfloor.

Certain variations employ a two-stage buckling column design, as follows. A main column type buckles under a first critical pressure and a second column type is designed to buckle at a second, higher critical pressure. In these variations, a small impact may buckle the main columns while a heavy fall may buckle both main and second columns. For example, the first critical pressure may be selected from about 5 psi to about 50 psi (e.g., about 25 psi) while the second critical pressure may be selected from about 20 psi to about 100 psi (e.g., about 50 psi).

In some embodiments, the flooring apparatus further comprises an anti-microbial material. The anti-microbial material may be introduced, for example, during production of the flooring plate. In some embodiments, an anti-microbial material is added to a flooring apparatus after it is fabricated, or even after it is installed at its point of use. One or more anti-microbial materials may be introduced within the flooring plate, within the matrix material, within the columns, or onto any surfaces present, including the top surface of the flooring plate and any other coatings that may be present at the point of use.

Any effective anti-microbial material may be employed, such as (but not limited to) lactic acid, citric acid, acetic acid, and their salts. Silver-based compounds may also be employed as anti-microbial materials. In some embodiments, Biosafe® silane-based anti-microbial materials (RTP Company, Winona, Minn., US) may be employed. Other embodiments employ Triclosan anti-microbial materials.

Some embodiments of this invention further include one or more flame retardants within the flooring apparatus, such as within the flooring plate and/or within the matrix material. The inclusion of a flame retardant can reduce or prevent flammability, measured (for example) in accordance with ASTM E-648 tunnel burn testing with a Class 1 rating. Flame retardants can reduce, and preferably eliminate, the potential for smoke generation and reduce smoke density values. In some embodiments, the flame retardant materials pass California Standard 117 fire retardant testing.

Exemplary flame retardants include, but are not limited to, alkyl phosphates, phosphazenes, phosphorous, and halogenated (e.g., fluorinated) derivatives thereof. It may be desirable to employ non-halogenated flame retardants. In another embodiment, FRX Polymers non-halogenated flame retardants may be employed.

Certain embodiments utilize JJAZZ™ non-halogenated flame retardants, which can eliminate the need for a catalyst addition to Texin DP7 and similar materials. JJAZZ flame retardants are based on amino phosphates, are non-toxic and non-corrosive, offer good hydrolytic stability, have low smoke characteristics, and are easy to UV-stabilize. Optionally, a polymer modifier is included, such as JJI Technologies DP100 in combination with JJAZZ flame retardants.

Flame retardants may be introduced, for example, during production of the flooring plate. Flame retardants may be introduced directly into a thermoplastic, thermoset, or viscoelastic material used for the flooring plate and/or columns. It may be desirable to compound a flame retardant into a thermoplastic, thermoset, or viscoelastic material which is different from the material for the flooring plate and/or columns. For example, some embodiments compound JJAZZ flame retardants into Texin DP7 as a masterbatch material, to further blend with Texin 255 or Texin 260.

In some embodiments, a flame retardant, such as graphite foam (e.g., as available from GrafTech International Holdings, Inc, Parma, Ohio, US), is added to a flooring apparatus in thicknesses of 1/16', 1/8", or 3/8" (for example). The graphite foam may be added after the flooring apparatus is fabricated, or even after it is installed at its point of use.

Preferred embodiments of the flooring apparatus exhibit good durability for long periods of time and usage. To maintain good durability, the columns should be stable with respect to repeated buckling cycles—especially in areas that may be more susceptible to falls, such as in bathrooms. In some variations of the invention, the presence of a matrix material enhances the durability of the flooring so that it remains functional over two, three, four, five, or even more buckling cycles.

Another aspect of durability relates to prolonged exposure to relatively high static pressures. In certain environments, a flooring apparatus may repeatedly, periodically, or even continually, be subjected to static pressures in excess of the critical dynamic buckling pressure but lower than the critical static buckling pressure. Preferably, the columns should be stable over time in these situations.

Depending on the desired commercial use, various additional materials and components can be added to the flooring apparatus of the invention, as will be appreciated. In some embodiments, one or more purely ornamental surfaces, layers, paints, or coatings is added to the top layer to the flooring. In some embodiments, additional functional features are introduced, such as a coating or smart foam to offer slip resistance (useful, for example, for bathroom applications and shower mats) by reducing the coefficient of friction on the top surface of the flooring plate. Performance-enhancing or ornamental features may be added during fabrication (e.g., in-mold coatings), during installation, after installation, or even after some amount of use.

The flooring apparatus may be fabricated as a continuous flooring, or in various forms of modular sections or tiles. For example, tiles could be sewn into medical-grade vinyl to fabricate portable mats of suitable sizes. For certain commercial uses of the flooring apparatus, such as shower mats, it may be preferred to seal the matrix material so that it is not exposed during use. An integral-skin foam, previously described, may be utilized in embodiments as a moisture barrier in, for example, showers.

The present invention has utility in hospitals, long-term case facilities, nursing homes, homes, offices, gyms, health clubs, and so on. The apparatus provided, and principles relating thereto, can be utilized in any system or situation where absorbing forces would be beneficial. The invention is by no means limited to flooring apparatus. For example, the apparatus could be configured for walls, doors, counters, portable or stationary exercise surfaces, indoor or outdoor sporting equipment, or various vehicle impact surfaces. The apparatus may be portable, or the apparatus may be adapted for a system that is itself portable (e.g., motor vehicles, boats, and the like). The attenuated forces may be derived from any living or non-living object, including not only people but also animals, sensitive equipment, and so on.

EXAMPLES

Example 1

Figure 2:
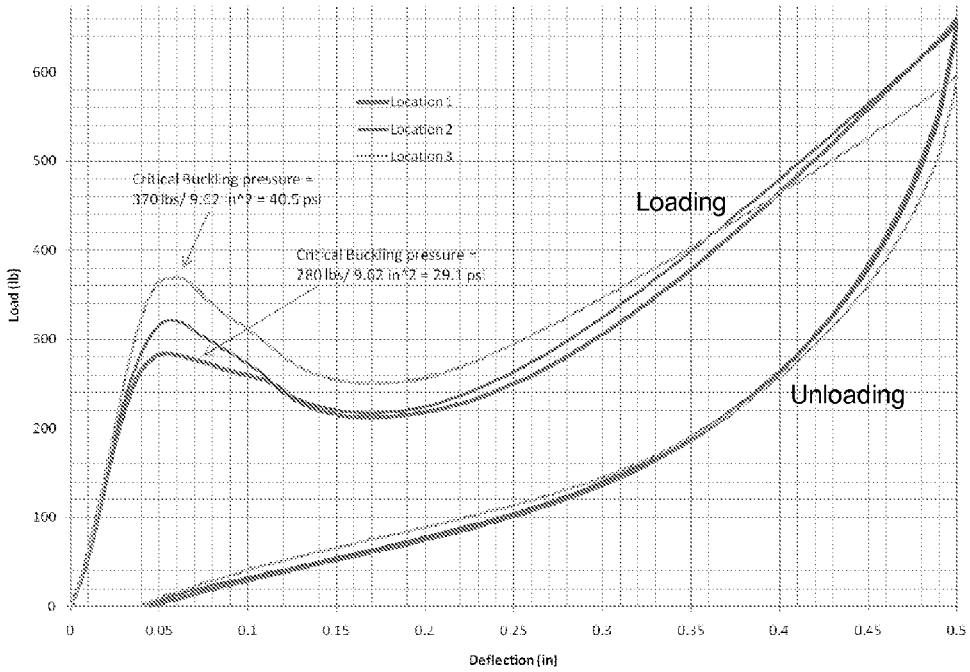
FIG. 2 depicts experimental load-deflection data used to estimate critical buckling pressures, in some embodiments.

In this example, a flooring apparatus is fabricated in accordance with embodiments of the invention (utilizing a matrix material). A section (tile) of the flooring apparatus is subjected to static load-deflection testing using a standard 3.5-inch-diameter metal load cylinder. FIG. 2 shows experimental static load-deflection curves for three different locations, demonstrating critical dynamic buckling pressures of about 30 psi to about 40 psi.

Example 2

Figure 3:
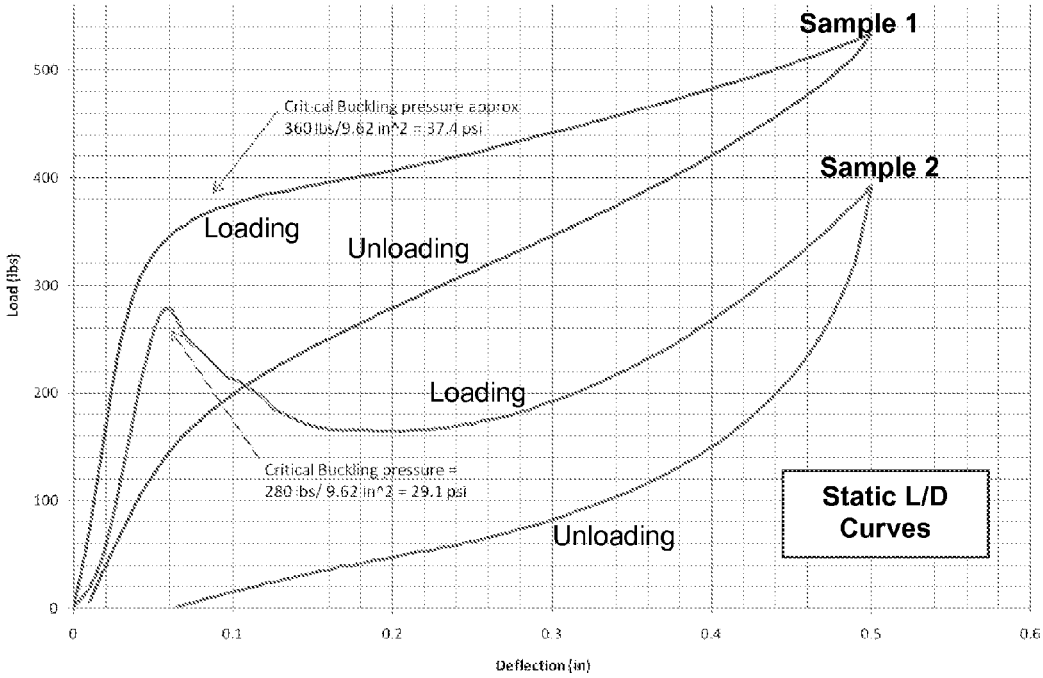
FIG. 3 depicts experimental load-deflection data used to estimate critical buckling pressures for certain samples of the invention.

In this example, two flooring apparatus are fabricated in accordance with embodiments of the invention (both utilizing matrix materials). A section (tile) of each flooring apparatus is subjected to static load-deflection testing using a standard 3.5-inch-diameter metal load cylinder. FIG. 3 shows experimental static load-deflection curves for two different samples, demonstrating a critical dynamic buckling pressures of 37 psi for Sample 1 and 29 psi for Sample 2.

Example 3

Figure 4:
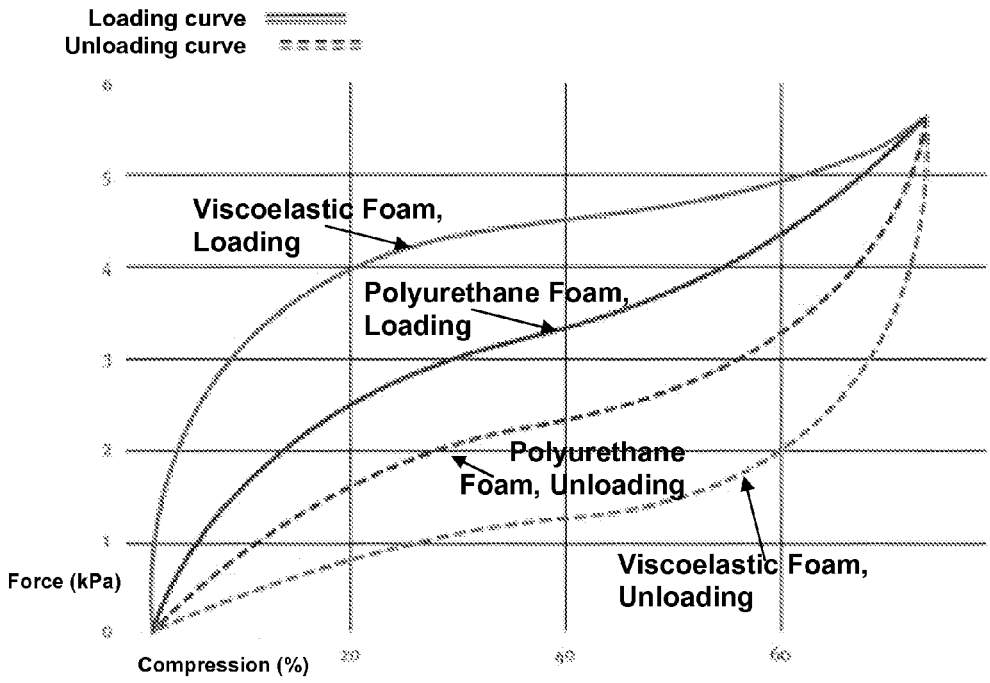
FIG. 4 presents force-compression data for certain matrix materials, according to some embodiments.

A standard polyurethane foam and a viscoelastic polyurethane foam, as possible matrix materials, are subjected to force-compression measurements. FIG. 4 shows experimental force-compression curves for these two different materials during loading and unloading.

Example 4

In this example, a variety of materials are utilized as the flooring plate and columns in flooring apparatus of the invention, and then testing using the G-force test wherein a 20-kg mass is dropped from a 0.35-meter height; the acceleration is measured (in $m/s^2$ or g's). As a control, a hard concrete floor with wood vinyl on the top gives an impact acceleration of 615 g's.

A flooring apparatus with S-95 polyurethane as the flooring plate and columns, and no matrix material, results in an impact acceleration of 82 g's, or about 87% force attenuation relative to the control floor.

A flooring apparatus with S-95 polyurethane as the flooring plate and columns, and with a polyurethane foam matrix material, results in an impact acceleration of 43 g's, or about 93% force attenuation relative to the control floor.

A flooring apparatus with S-95 polyurethane as the flooring plate and columns, with a polyurethane foam matrix material, and additionally including a wood vinyl top, results in an impact acceleration of 56 g's, or about 91% force attenuation relative to the control floor.

A flooring apparatus with Texin 245 polyurethane as the flooring plate and columns, and no matrix material, results in an impact acceleration of 103 g's, or about 83% force attenuation relative to the control floor.

A flooring apparatus with Texin 245 polyurethane as the flooring plate and columns, and with a polyurethane foam matrix material, results in an impact acceleration of 71 g's, or about 88% force attenuation relative to the control floor.

A flooring apparatus with Texin 245 polyurethane as the flooring plate and columns, with a polyurethane foam matrix material, and additionally including a wood vinyl top, results in an impact acceleration of 75 g's, or about 88% force attenuation relative to the control floor.

A flooring apparatus with low-density polyethylene used in the flooring plate and columns, and no matrix material, results in an impact acceleration of 56 g's, or about 91% force attenuation relative to the control floor. Some column damage is observed after the measurement.

Example 5

This Example provides biomechanical testing of five exemplary flooring apparatus of the invention.

One way to measure impact forces and flooring performance is by biomechanical testing, in which simulations are carried out with a selected subject (human model) weight and fall angle. For example, one can consider the forces that occur to fracture an elderly female cadaveric proximal femur in a fall loading configuration (Laing and Robinovitch, "Low stiffness floors can attenuate fall-related femoral impact forces by up to 50% without substantially impairing balance in older women," *Accident Analysis and Prevention* 41 (2009) 642-650). A 49.5-degree fall angle can be selected as an angle that represents a severe fall, producing an impact velocity of 4 m/s, for example.

In the Laing and Robinovitch study, the mean value for simulated fracture was about 2800 N, and the standard deviation was about 1000 N. Therefore, it would be desirable to provide a flooring apparatus capable of reducing the experience force (in this particular test) to a value substantially lower than 2800 N. In testing of the apparatus in this example, peak forces of about 1800 N or less are measured. Assuming a normal distribution in fracture strength among the population of older women, it is estimated that about 68% of individuals who would otherwise fracture would be protected by the apparatus.

Figure 5:
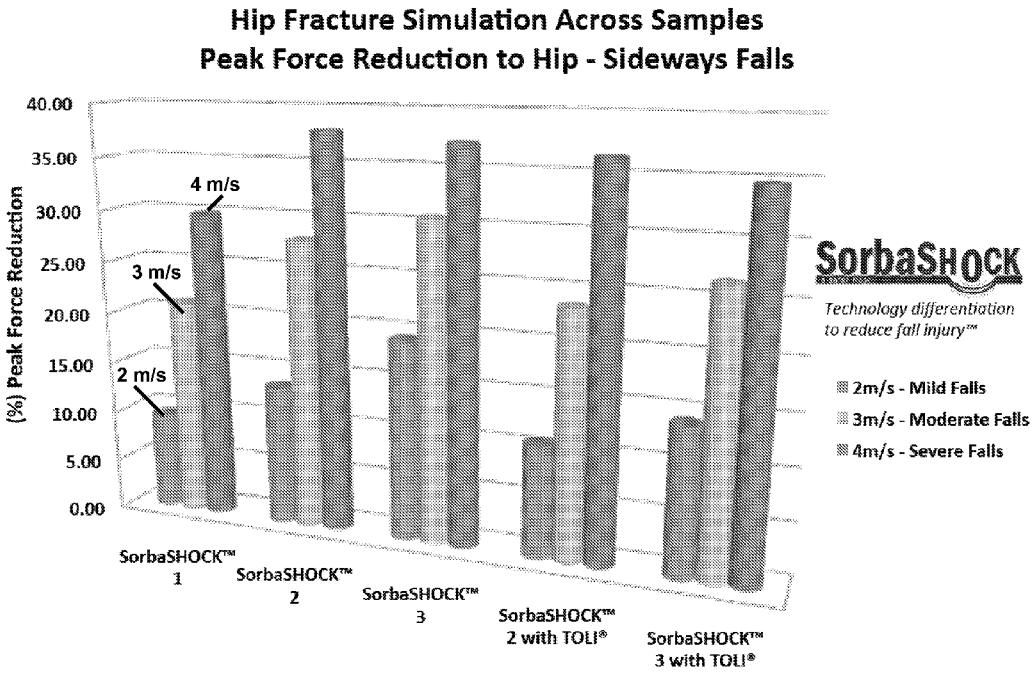
FIG. 5 illustrates hip-fracture simulations relating to certain embodiments of the present invention.

FIG. 5 shows peak-force reduction for five SorbaShock sample apparatus and three different impact velocities (2, 3, and 4 m/s). SorbaShock samples 1, 2, and 3 are tested without flooring covering. Additionally, samples 2 and 3 additionally including TOLI® commercial covering (CBC Flooring, Commack, N.Y., US) are tested, indicating only a small drop in peak-force reduction when the covering is included. It is noted that as the impact velocity increases, the percent peak-force reduction also increases. Thus, the intended function of the flooring apparatus actually improves as the severity of falls rises.

Although illustrative embodiments and examples, and various modifications thereof, have been described in detail herein, one skilled in the art will appreciate that the present application need not be limited to these precise embodiments and the described modifications, and that various changes and further modifications may be practiced without departing from the scope or spirit of the invention as defined in the appended claims.

Other embodiments will be apparent to those of ordinary skill in the art, including embodiments that do not provide all of the features and advantages set forth herein. These other embodiments are also within the scope of this invention as claimed.

What is claimed is:

1. An apparatus comprising:

(a) an outer plate for receiving a force associated with an impact of a human, wherein said outer plate has a flexural modulus selected from 10,000 psi to 20,000 psi;

(b) a plurality of columns extending from an inner surface of said outer plate, wherein said columns do not buckle when said outer plate is subjected to a static pressure up to a critical static buckling pressure from 60 psi to 300 psi, wherein at least some of said columns buckle when said outer plate is subjected to a dynamic pressure equal to or greater than a critical dynamic buckling pressure, wherein said critical dynamic buckling pressure is from 18 psi to 45 psi, and wherein said critical static buckling pressure is at least 40 psi higher than said critical dynamic buckling pressure; and (c) a matrix material in at least partial contact with said columns, wherein said apparatus provides a G-force attenuation of at least 80% compared to said apparatus without said columns or said matrix material.

2. The apparatus of claim 1, wherein said matrix material has a density selected from 1 $lb/ft^3$ to 12 $lb/ft^3$.

3. The apparatus of claim 2, wherein said density is selected to optimize the stiffness of said columns.

4. The apparatus of claim 1, wherein said matrix material increases the stiffness of said columns by at least 50%, compared to the column stiffness in the absence of said matrix material.

5. The apparatus of claim 1, wherein said matrix material includes a bulk foam material and an integral-skin foam that is present as closed cells.

6. The apparatus of claim 1, wherein said matrix material includes both a structural material with a first stiffness and a viscoelastic material with a second stiffness that is lower than said first stiffness.

7. The apparatus of claim 1, wherein said matrix material is configured with cell structures that are not isotropic.

8. The flooring apparatus of claim 1, wherein the flexural modulus of said matrix material is the same as the flexural modulus of said outer plate.

9. The apparatus of claim 1, wherein said G-force attenuation is at least 85%.

10. The apparatus of claim 9, wherein said G-force attenuation is at least 90%.

11. The apparatus of claim 1, wherein said apparatus is a flooring apparatus and said outer plate includes a flooring plate.

12. A flooring apparatus comprising:

(a) a flooring plate for receiving a force associated with an impact of a human, wherein said flooring plate has a flexural modulus selected from 10,000 psi to 20,000 psi;

(b) a plurality of columns extending from an inner surface said flooring plate, wherein said columns do not buckle when said outer plate is subjected to a static pressure up to a critical static buckling pressure from 60 psi to 300 psi, wherein at least some of said columns buckle when said flooring plate is subjected to a dynamic pressure equal to or greater than a critical dynamic buckling pressure, wherein said critical dynamic buckling pressure is from 18 psi to 45 psi, and wherein said critical static buckling pressure is at least 40 psi higher than said critical dynamic buckling pressure;

(c) a matrix material in at least partial contact with said columns; and (d) one or more flame retardants contained within or on a surface of said flooring plate, wherein said flooring apparatus provides a G-force attenuation of at least 80% compared to said flooring apparatus without said columns or said matrix material.

13. The flooring apparatus of claim 12, wherein said flame retardant is selected from the group consisting of alkyl phosphates, amino phosphates, phosphazenes, phosphorous, and halogenated derivatives of any of the foregoing.

14. The flooring apparatus of claim 12, further comprising one or more anti-microbial materials contained within or on a surface of said flooring plate.

15. The flooring apparatus of claim 12, wherein said matrix material includes a bulk foam material and an integral-skin foam that is present as closed cells.

16. The flooring apparatus of claim 15, further comprising one or more flame retardants contained within said matrix material.

17. The flooring apparatus of claim 12, wherein said apparatus is fabricated from one or more thermoplastic polyurethanes.

18. A flooring apparatus comprising a flooring plate and a plurality of columns extending from an inner surface of said flooring plate, wherein said columns are capable of buckling under a sufficient G-force;

wherein said columns, when buckled, store potential energy received from said G-force in the form of strain energy to enhance resilience of said flooring apparatus;

wherein said apparatus provides a G-force attenuation of at least 90%% compared to said apparatus without said columns;

wherein said flooring plate has a flexural modulus selected from 10,000 psi to 20,000 psi;

wherein said columns do not buckle when said outer plate is subjected to a static pressure up to a critical static buckling pressure from 60 psi to 300 psi; and wherein at least some of said columns buckle when said flooring plate is subjected to a dynamic pressure equal to or greater than a critical dynamic buckling pressure that is from 18 psi to 45 psi; and wherein said critical static buckling pressure is at least 40 psi higher than said critical dynamic buckling pressure.

19. The flooring apparatus of claim 18, wherein at least a portion of said columns are configured for uni-directional buckling.

20. The flooring apparatus of claim 18, wherein at least a portion of said columns are configured for buckling about any axis.

21. The flooring apparatus of claim 18, wherein at least a portion of said columns are substantially round in cross section.

22. The flooring apparatus of claim 18, comprising a two-stage buckling configuration wherein a first column type is designed to buckle under a first critical buckling pressure, and wherein a second column type is designed to buckle under a second critical buckling pressure that is higher than said first critical buckling pressure.

* * * * *